US011335263B2

(12) United States Patent
Yuan et al.

(10) Patent No.: US 11,335,263 B2
(45) Date of Patent: May 17, 2022

(54) PIXEL DRIVING METHOD, DISPLAY DRIVING METHOD AND DISPLAY SUBSTRATE

(71) Applicants: Hefei BOE Joint Technology Co., Ltd., Anhui (CN); BOE Technology Group Co., Ltd., Beijing (CN)

(72) Inventors: Can Yuan, Beijing (CN); Pan Xu, Beijing (CN); Yongqian Li, Beijing (CN); Zhidong Yuan, Beijing (CN)

(73) Assignees: HEFEI BOE JOINT TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/271,914

(22) PCT Filed: May 13, 2020

(86) PCT No.: PCT/CN2020/089984
§ 371 (c)(1),
(2) Date: Feb. 26, 2021

(87) PCT Pub. No.: WO2021/226864
PCT Pub. Date: Nov. 18, 2021

(65) Prior Publication Data
US 2022/0122533 A1 Apr. 21, 2022

(51) Int. Cl.
*G09G 3/3233* (2016.01)

(52) U.S. Cl.
CPC ..... *G09G 3/3233* (2013.01); *G09G 2300/043* (2013.01); *G09G 2300/0452* (2013.01);
(Continued)

(58) Field of Classification Search
None
See application file for complete search history.

(56) References Cited

U.S. PATENT DOCUMENTS

2002/0033809 A1* 3/2002 Nakajima ..... G09G 3/2003 345/204
2006/0227628 A1* 10/2006 Eriguchi ..... G09G 3/3688 365/189.07

(Continued)

*Primary Examiner* — Dorothy Harris
(74) *Attorney, Agent, or Firm* — Nath, Goldberg & Meyer; Joshua B. Goldberg

(57) ABSTRACT

Pixel driving method for driving pixel unit, display driving method and display substrate are provided. The pixel unit includes pixel driving circuit, including driving transistor, storage capacitor, and data writing circuit, the driving transistor has control electrode coupled to first terminal of the data writing circuit and the storage capacitor, and first electrode coupled to second terminal of the storage capacitor, and second terminal of the data writing circuit is coupled to data line. The pixel driving method includes: loading a data voltage into the data line, and controlling the first and second terminals of the data writing circuit to be connected; controlling the data line to be floating, and maintaining connection between the first and second terminals of the data writing circuit to reduce gate-source voltage of the driving transistor; and controlling the first and second terminals of the data writing circuit to be disconnected.

18 Claims, 7 Drawing Sheets

(52) U.S. Cl.
CPC ..... *G09G 2300/0819* (2013.01); *G09G 2300/0842* (2013.01); *G09G 2310/0297* (2013.01); *G09G 2310/08* (2013.01); *G09G 2320/045* (2013.01)

(56) References Cited

U.S. PATENT DOCUMENTS

| | | | | |
|---|---|---|---|---|
| 2006/0227638 | A1* | 10/2006 | Kudo | G09G 3/20 365/203 |
| 2011/0122119 | A1* | 5/2011 | Bae | G09G 3/3233 345/211 |
| 2017/0110055 | A1* | 4/2017 | Li | G09G 3/3266 |

* cited by examiner

PIXEL DRIVING METHOD, DISPLAY DRIVING METHOD AND DISPLAY SUBSTRATE

CROSS-REFERENCE TO RELATED APPLICATION

This is a National Phase Application filed under 35 U.S.C. 371 as a national stage of PCT/CN2020/089984, filed on May 13, 2020, the content of which is hereby incorporated by reference in its entirety.

TECHNICAL FIELD

The present disclosure relates to the field of display, and in particular, to a pixel driving method, a display driving method, and a display substrate.

BACKGROUND

Currently, organic light-emitting diode (OLED) display devices have been widely applied to smart products such as mobile phones, televisions, and laptops due to their advantages of self-luminescence, wide viewing angle and high contrast.

In the related art, gamma input voltages of different color channels in an OLED display device are combined, and only one gamma circuit is provided in a whole chip. In this case, digital to analog converters (DACs) of all colors are coupled to a same gamma circuit. During grayscale expansion, an operating voltage corresponding to each grayscale is determined based on an operating voltage range of a color channel which has the maximum operating voltage range, and this is the conventional digital gamma correction. However, such a method will make a color channel with a relatively small operating voltage range fail to display all grayscales, that is, cause grayscale loss, and finally affect a display effect of the OLED display device.

SUMMARY

To at least solve one of the technical problems in the related art, the present disclosure provides a pixel driving method, a display driving method and a display substrate.

In a first aspect, the embodiments of the present disclosure provide a pixel driving method for driving a pixel unit. The pixel unit includes a pixel driving circuit including: a driving transistor, a storage capacitor, and a data writing circuit, a control electrode of the driving transistor is coupled to a first terminal of the data writing circuit and a first terminal of the storage capacitor, a first electrode of the driving transistor is coupled to a second terminal of the storage capacitor, and a second terminal of the data writing circuit is coupled to a data line.

The pixel driving method includes:

loading a data voltage into the data line, and controlling the first terminal of the data writing circuit and the second terminal of the data writing circuit to be connected;

controlling the data line to be in a floating state, and maintaining the connection between the first terminal of the data writing circuit and the second terminal of the data writing circuit, so as to reduce a gate-source voltage of the driving transistor; and controlling the first terminal of the data writing circuit and the second terminal of the data writing circuit to be disconnected.

In some embodiments, the pixel driving circuit further includes a threshold compensation circuit coupled to the control electrode of the driving transistor and the first electrode of the driving transistor; and before the step of loading the data voltage into the data line, the pixel driving method further includes:

controlling the threshold compensation circuit to obtain a threshold voltage of the driving transistor, and making a voltage difference between the first terminal of the storage capacitor and the second terminal of the storage capacitor be equal to the threshold voltage.

In some embodiments, before the step of controlling the data line to be in the floating state, and maintaining the connection between the first terminal of the data writing circuit and the second terminal of the data writing circuit, the pixel driving method further includes:

determining a duration of the floating state of the data line according to the data voltage.

In some embodiments, the durations of the floating state of the data line corresponding to different data voltages are the same;

or, the durations of the floating state of the data line corresponding to different data voltages are different.

In some embodiments, a duration of the step of controlling the data line to be in the floating state, and maintaining the connection between the first terminal of the data writing circuit and the second terminal of the data writing circuit ranges from 0.5 μs to 1.5 μs.

In some embodiments, a duration of the step of loading the data voltage into the data line, and controlling the first terminal of the data writing circuit and the second terminal of the data writing circuit to be connected is t1; and the duration of the step of controlling the data line to be in the floating state, and maintaining the connection between the first terminal of the data writing circuit and the second terminal of the data writing circuit is t2, and t2=t1.

In a second aspect, the embodiments of the present disclosure further provide a display driving method for driving a display substrate. The display substrate includes a plurality of pixel units arranged in an array, each pixel unit includes a pixel driving circuit and a light-emitting element, and the pixel driving circuit includes a driving transistor, a storage capacitor, and a data writing circuit. A control electrode of the driving transistor is coupled to a first terminal of the data writing circuit and a first terminal of the storage capacitor, a first electrode of the driving transistor is coupled to a second terminal of the storage capacitor, and a second terminal of the data writing circuit is coupled to a corresponding data line; and the plurality of pixel units include a first-type pixel unit and a second-type pixel unit, and luminous efficiency of the light-emitting element in the first-type pixel unit is greater than luminous efficiency of the light-emitting element in the second-type pixel unit. The display driving method includes:

driving the first-type pixel unit, which includes:

loading a data voltage into the data line coupled to the first-type pixel unit, and controlling the first terminal of the data writing circuit and the second terminal of the data writing circuit in the first-type pixel unit to be connected;

controlling the data line coupled to the first-type pixel unit to be in a floating state, and maintaining the connection between the first terminal of the data writing circuit and the second terminal of the data writing circuit in the first-type pixel unit, so as to reduce a gate-source voltage of the driving transistor; and controlling the first terminal of the data writing circuit and the second terminal of the data writing circuit in the first-type pixel unit to be disconnected.

In some embodiments, in the process of driving the first-type pixel unit, before the step of controlling the data line coupled to the first-type pixel unit to be in the floating state, and maintaining the connection between the first terminal of the data writing circuit and the second terminal of the data writing circuit in the first-type pixel unit, the display driving method further includes:

determining a duration of the floating state of the data line according to the data voltage.

In some embodiments, the durations of the floating state of the data line corresponding to different data voltages are the same;

or, the durations of the floating state of the data line corresponding to different data voltages are different.

In some embodiments, the pixel driving circuit further includes a threshold compensation circuit coupled to the control electrode of the driving transistor and the first electrode of the driving transistor; and in the process of driving the first-type pixel unit, before the step of loading the data voltage into the data line coupled to the first-type pixel unit, and controlling the first terminal of the data writing circuit and the second terminal of the data writing circuit in the first-type pixel unit to be connected, the display driving method further includes:

controlling the threshold compensation circuit in the first-type pixel unit to obtain a threshold voltage of the driving transistor, and making a voltage difference between the first terminal of the storage capacitor and the second terminal of the storage capacitor be equal to the threshold voltage.

In some embodiments, the display driving method further includes:

driving the second-type pixel unit, which includes:

loading a data voltage into the data line coupled to the second-type pixel unit, and controlling the first terminal of the data writing circuit and the second terminal of the data writing circuit in the second-type pixel unit to be connected; and controlling the first terminal of the data writing circuit and the second terminal of the data writing circuit in the second-type pixel unit to be disconnected.

In some embodiments, the pixel driving circuit further includes a threshold compensation circuit coupled to the control electrode of the driving transistor and the first electrode of the driving transistor; and in the process of driving the second-type pixel unit, before the step of loading the data voltage into the data line coupled to the second-type pixel unit, and controlling the first terminal of the data writing circuit and the second terminal of the data writing circuit in the second-type pixel unit to be connected, the display driving method further includes:

controlling the threshold compensation circuit in the second-type pixel unit to obtain a threshold voltage of the driving transistor, and making a voltage difference between the first terminal of the storage capacitor and the second terminal of the storage capacitor be equal to the threshold voltage.

In some embodiments, the plurality of pixel units include a first pixel unit, a second pixel unit, and a third pixel unit, luminous efficiency of the light-emitting element in the first pixel unit is greater than luminous efficiency of the light-emitting element in the second pixel unit, and the luminous efficiency of the light-emitting element in the second pixel unit is greater than luminous efficiency of the light-emitting element in the third pixel unit; and the first-type pixel unit includes the first pixel unit and the second pixel unit, and the second-type pixel unit includes the third pixel unit.

In some embodiments, the light-emitting element in the first pixel unit is a red light-emitting element, the light-emitting element in the second pixel unit is a green light-emitting element, and the light-emitting element in the third pixel unit is a blue light-emitting element.

In a third aspect, the embodiments of the present disclosure further provide a display substrate including a display region and a non-display region at the periphery of the display region. The display region includes a plurality of pixel units arranged in an array, each pixel unit includes a pixel driving circuit and a light-emitting element, and the pixel driving circuit includes a driving transistor, a storage capacitor and a data writing circuit. A control electrode of the driving transistor is coupled to a first terminal of the data writing circuit and a first terminal of the storage capacitor, a first electrode of the driving transistor is coupled to a second terminal of the storage capacitor, a second terminal of the data writing circuit is coupled to a corresponding data line, and a third terminal of the data writing circuit is coupled to a corresponding gate line;

the plurality of pixel units include a first-type pixel unit and a second-type pixel unit, and luminous efficiency of the light-emitting element in the first-type pixel unit is greater than luminous efficiency of the light-emitting element in the second-type pixel unit; and the non-display region is provided with a display driver module configured to perform the display driving method provided in the second aspect.

In some embodiments, the plurality of pixel units includes a first pixel unit, a second pixel unit, and a third pixel unit, luminous efficiency of the light-emitting element in the first pixel unit is greater than luminous efficiency of the light-emitting element in the second pixel unit, and the luminous efficiency of the light-emitting element in the second pixel unit is greater than luminous efficiency of the light-emitting element in the third pixel unit;

the first-type pixel unit includes the first pixel unit and the second pixel unit, and the second-type pixel unit includes the third pixel unit; and each row of pixel units is provided with two gate lines, and for any row of pixel units, all first pixel units in the row are coupled to one of the two gate lines provided for the row, and all second and third pixel units in the row are coupled to the other of the two gate lines provided for the row.

In some embodiments, the non-display region is further provided with a plurality of multiplexer circuits, and each of the plurality of multiplexer circuits corresponds to at least two columns of pixel units; and each of the plurality of multiplexer circuits is provided with one data signal input terminal and at least two data signal output terminals, the at least two data signal output terminals are respectively coupled to at least two data lines provided for the at least two columns of pixel units corresponding to the multiplexer circuit, and the at least two data signal output terminals are in one-to-one correspondence with the at least two data lines.

In some embodiments, the light-emitting element includes an OLED.

DETAILED DESCRIPTION

Figure 1:
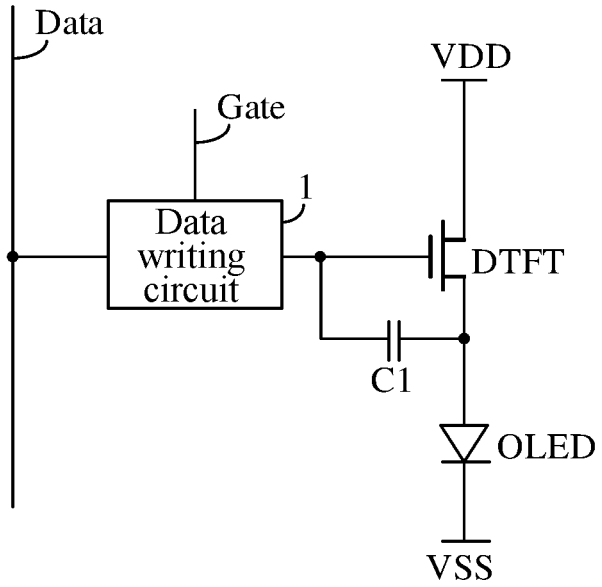
FIG. 1 is a schematic diagram of a circuit structure of a pixel driving circuit according to an embodiment of the present disclosure.

In order to enable those of ordinary skill in the art to better understand the technical solutions of the present disclosure, a pixel driving method, a display driving method and a display substrate provided by the present disclosure are described in detail below with reference to the accompanying drawings.

As for OLED display devices, deposition methods of a thin film in an OLED mainly include a vacuum evaporation method and a solution processing method; and a technique of fabricating a light-emitting layer of a large-size top emission OLED device by inkjet printing has the advantages of high material utilization rate, low energy consumption, low cost, simple device structure, and being applicable to the fabrication of large-area displays.

When OLEDs emitting light of different colors are fabricated by an inkjet printing process, the OLEDs emitting light of different colors have different luminous efficiencies due to factors such as luminous materials and film thicknesses. In general, the luminous efficiency of a red OLED is higher than that of a green OLED, and the luminous efficiency of the green OLED is higher than that of a blue OLED; that is, when a same driving current is applied, luminance of the red OLED is higher than that of the green OLED, and the luminance of the green OLED is higher than that of the blue OLED.

Taking an RGB-type OLED display device as an example, a specific process of grayscale expansion is as below.

Firstly, data voltages required to be applied to a red OLED, a green OLED and a blue OLED to realize a preset maximum luminance (which is preset as required, and may be, for example, 150 nit) are respectively determined by testing, and are respectively recorded as Vr_max, Vg_max, and Vb_max to serve as a maximum operating voltage of a pixel unit including the red OLED (referred to as a red pixel unit), a maximum operating voltage of a pixel unit including the green OLED (referred to as a green pixel unit), and a maximum operating voltage of a pixel unit including the blue OLED (referred to as a blue pixel unit). That is, an operating voltage range of the red pixel unit is 0-Vr_max, an operating voltage range of the green pixel unit is 0-Vg_max, and an operating voltage range of the blue pixel unit is 0-Vb_max. Since the luminous efficiency of the red OLED is higher than that of the green OLED and the luminous efficiency of the green OLED is higher than that of the blue OLED, it is satisfied that Vr_max<Vg_max<Vb_max, that is, the blue pixel unit has the maximum operating voltage range.

Next, grayscale division is performed based on the operating voltage range 0-Vb_max of the blue pixel unit. Taking a case where the grayscales is expressed by 8 bits as an example, $2^8$ (i.e., 256) grayscales (L0 to L255) can be obtained. Then, voltages, which are within the operating voltage range 0-Vb_max, corresponding to the grayscales L0 to L255 are determined based on a certain algorithm, for example, the voltage corresponding to L0 is 0V, and the voltage corresponding to L255 is Vb_max.

In the case where the grayscale expansion is performed based on the operating voltage range of the blue pixel unit, since the maximum operating voltage Vr_max of the red pixel unit and the maximum operating voltage Vg_max of the green pixel unit are both lower than the maximum operating voltage Vb_max of the blue pixel unit, the red pixel unit and the green pixel unit cannot display part of high grayscales, that is, grayscale loss exists in the red pixel unit and the green pixel unit. The larger the difference between Vr_max and Vb_max is, the more grayscales the red pixel unit loses; and the larger the difference between Vg_max and Vb_max is, the more grayscales the green pixel unit loses.

In view of the technical problems in the related art, the present disclosure provides corresponding solutions.

Transistors in the present disclosure may be thin film transistors or field effect transistors or other switching devices having the same characteristics. In general, a transistor includes three electrodes: a gate, a source and a drain, and the source and the drain in the transistor are symmetrical in structure and are interchangeable as required. In the present disclosure, a control electrode refers to a gate of a transistor, and one of a first electrode and a second electrode is a source and the other is a drain.

In addition, transistors can be classified into N-type transistors and P-type transistors according to their characteristics. In a case where a transistor is an N-type transistor, a turn-on voltage thereof is a high level voltage, and a turn-off voltage thereof is a low level voltage; and in a case where a transistor is a P-type transistor, a turn-on voltage thereof is a low level voltage, and a turn-off voltage thereof is a high level voltage.

In the following description of the embodiments, exemplary illustration is given by taking a case where each transistor is an N-type transistor as an example. In this case, an active level refers to a high level, and an inactive level refers to a low level. However, those of ordinary skill in the art should be aware that each transistor in the embodiments may be a P-type transistor.

Figure 2:
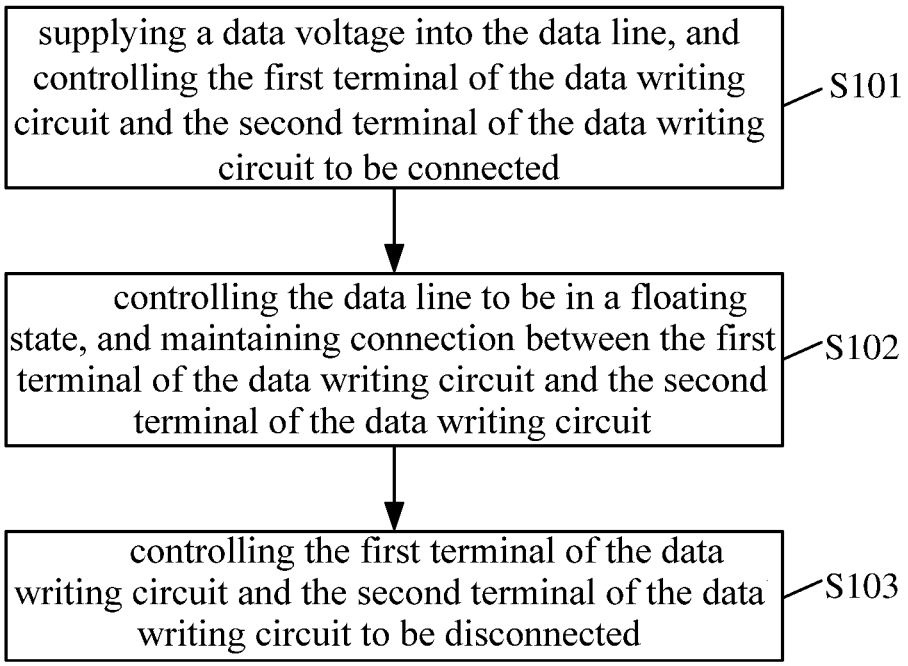
FIG. 2 is a flowchart of a pixel driving method according to an embodiment of the present disclosure.

FIG. 1 is a schematic diagram of a circuit structure of a pixel driving circuit according to an embodiment of the present disclosure, and FIG. 2 is a flowchart of a pixel driving method according to an embodiment of the present disclosure. As shown in FIG. 1 and FIG. 2, the pixel driving method is used for driving a pixel unit, which includes a pixel driving circuit and a light-emitting element. The pixel driving circuit includes a driving transistor DTFT, a storage capacitor C1 and a data writing circuit 1. A control electrode of the driving transistor DTFT is coupled to a first terminal of the data writing circuit 1 and a first terminal of the storage capacitor C1, a first electrode of the driving transistor DTFT is coupled to a second terminal of the storage capacitor C1, a second electrode of the driving transistor DTFT is coupled to a high level voltage supply terminal VDD, and a second terminal of the data writing circuit 1 is coupled to a data line Data. The light-emitting element may be an OLED, which may be a top emission OLED fabricated by an inkjet printing process. The pixel driving method includes the following steps.

Step S101 includes: supplying a data voltage into the data line, and controlling the first terminal of the data writing circuit and the second terminal of the data writing circuit to be conducted.

The step S101 is a data writing stage, a data voltage on the data line Data can be written to the control electrode of the driving transistor DTFT through the data writing circuit 1 to complete data writing. At the end of the step S101, a gate-source voltage (i.e., a voltage difference between the control electrode of the driving transistor DTFT and the first electrode of the driving transistor DTFT) of the driving transistor DTFT is recorded as Vgs.

Step S102 includes: controlling the data line to be in a floating state, and maintaining the connection between the first terminal of the data writing circuit and the second terminal of the data writing circuit, so as to reduce the gate-source voltage of the driving transistor.

The step S102 is a gate-source voltage reducing stage. Since the data line is in the floating state and the first terminal of the data writing circuit 1 is connected to the second terminal of the data writing circuit 1, a parasitic capacitor corresponding to the data line Data is coupled in series with the storage capacitor C1 in the pixel driving circuit, and the first terminal of the storage capacitor C1 is also in a floating state. Meanwhile, since the driving transistor DTFT is in an on state, a driving current output by the driving transistor DTFT charges the second terminal of the storage capacitor C1, and a voltage of the second terminal of the storage capacitor C1 changes.

A voltage variation of the second terminal of the storage capacitor C1 is recorded as ΔV, where ΔV>0, and ΔV is related to factors such as a current (supplied to the control electrode of the driving transistor DTFT by the data line in the step S101) output by the driving transistor DTFT, the duration of the step S102, the capacitance of the storage capacitor C1, and the equivalent capacitance of the light-emitting element. The larger the current is or the longer the duration of the step S102 is, the larger ΔV is; the smaller the capacitance of the storage capacitor C1 is or the smaller the equivalent capacitance of the light-emitting element is, the larger ΔV is.

The longer the duration of the step S102 is, the more the gate-source voltage of the driving transistor DTFT is reduced, the larger the operating voltage range of the pixel unit is expanded, and the higher the control difficulty of ΔV is. Considering the expansion of the operating voltage range and the control difficulty of ΔV, the duration t2 of the step S102 in the embodiment of the present disclosure is in the range of 0.5 μs to 1.5 μs, preferably is 1 μs.

In some embodiments, the duration t1 of the step S101 is equal to the duration t2 of the step S102.

Under a bootstrap effect of the storage capacitor C1, a voltage at the first terminal of the storage capacitor C1 changes accordingly. Since the parasitic capacitor corresponding to the data line Data is coupled in series with the storage capacitor C1 in the pixel driving circuit, a voltage variation ΔV' of the first terminal of the storage capacitor C1 can be represented as follows according to charge conservation:

$$\Delta V' = \Delta V * C1/(C1+Cst)$$

where Cst is the capacitance of the parasitic capacitor corresponding to the data line Data, and Cst is much larger than C1.

At the end of the step S102, the gate-source voltage of the driving transistor DTFT is recorded as Vgs':

$$\begin{aligned} Vgs' &= Vgs + \Delta V' - \Delta V \\ &= Vgs + \Delta V * C1/(C1 + Cst) - \Delta V \\ &= Vgs - \Delta V * Cst/(C1 + Cst) \end{aligned}$$

Since ΔV>0, Vgs'<Vgs. Therefore, the gate-source voltage Vgs' obtained at the end of the step S102 is reduced in comparison with the gate-source voltage Vgs at the end of the step S101.

Step S103 includes: controlling the first terminal of the data writing circuit and the second terminal of the data writing circuit to be disconnected.

The step S103 is a stable light-emitting stage, the first terminal of the data writing circuit 1 and the second terminal of the data writing circuit 1 are disconnected, and at this time, the driving transistor DTFT outputs the driving current under the action of the gate-source voltage Vgs' to drive the light-emitting element OLED to emit light.

In the step S103, although the driving current output by the driving transistor DTFT causes the voltage of the second terminal of the storage capacitor C1 to change, the voltage of the first terminal of the storage capacitor C1 will change synchronously with the change of the voltage of the second terminal of the storage capacitor C1 because the first terminal of the data writing circuit 1 and the second terminal of the data writing circuit 1 are disconnected, so that the gate-source voltage Vgs' of the driving transistor DTFT remains unchanged, the driving transistor DTFT outputs stable driving current, and the light-emitting element OLED can emit light stably.

In the embodiment of the present disclosure, when the data voltage loaded in the step S101 is the existing maximum operating voltage of the pixel unit, the luminance of the light-emitting element OLED is lower than the preset maximum luminance in the step S103 because the gate-source voltage of the driving transistor DTFT is reduced in the step S102. In a case where the pixel unit is driven using the pixel driving method provided by the embodiment of the present disclosure, in order that the luminance of the light-emitting element OLED reaches the preset maximum luminance of the light-emitting element OLED, the existing maximum operating voltage of the pixel unit can be increased to increase the gate-source voltage of the driving transistor DTFT obtained at the end of the step S101, and then the gate-source voltage of the driving transistor DTFT is reduced in the step S102 to make the gate-source voltage of the driving transistor DTFT obtained at the end of the step S102 be equal to a gate-source voltage matched with the preset maximum luminance of the light-emitting element OLED.

Based on the above, it can be seen that, by adopting the technical solution provided by the embodiment of the present disclosure, the maximum operating voltage corresponding to the pixel unit can be increased, that is, the operating voltage range of the pixel unit can be expanded, which is beneficial to reducing the grayscale loss of the pixel unit.

In some embodiments, before the step S102, the pixel driving method further includes:

step S102*a*, determining duration of the floating state of the data line according to the data voltage.

The duration t2 of the subsequent step S102 can be obtained through the step S102*a*.

As an alternative implementation, the durations t2 of the step S102 corresponding to different data voltages may be the same, and may be preset according to actual needs.

As an alternative example, when the pixel driving circuit drives the light-emitting element OLED to reach the preset maximum luminance with an existing pixel driving method, the corresponding existing maximum operating voltage (maximum data voltage) is recorded as Vdata_max and the corresponding gate-source voltage of the driving transistor DTFT is recorded as Vgs_max. When the pixel driving circuit drives the light-emitting element OLED to reach the preset maximum luminance with the pixel driving method provided by the present disclosure, the set maximum operating voltage is recorded as Vdata_max', with Vdata_max'>Vdata_max. The maximum operating voltage may be supplied to the pixel driving circuit, and then the pixel driving circuit may be controlled to operate by using the pixel driving method provided by the present disclosure to measure the required duration t2 of the step S102. Since Vdata_max'>Vdata_max, the gate-source voltage Vgs_max' of the driving transistor at the end of the step S101 satisfies Vgs_max'>Vgs_max; when performing the step S102, the gate-source voltage Vgs_max' of the driving transistor is continuously reduced, the gate-source voltage of the driving transistor DTFT is monitored in real time, the step S102 is ended when Vgs_max'=Vgs_max, and the duration t0 of the step S102 is measured. In actual pixel driving processes, the durations t2 of the step S102 corresponding to different data voltages are all equal to t0.

As another alternative implementation, the durations t2 of the step S102 corresponding to different data voltages may be different, and the duration of the step S102 corresponding to each data voltage may be preset according to actual needs.

As an alternative example, when the pixel driving circuit drives the light-emitting element OLED to reach the preset maximum luminance with the pixel driving method provided by the present disclosure, the set maximum operating voltage is Vdata_max', then the grayscale expansion is performed within a new operating voltage range (0 to Vdata_max'), and each grayscale Lm that can be covered by the new operating voltage range and a data voltage (also referred to as grayscale voltage) Vdata_Lm corresponding to each covered grayscale are determined, where m is an integer and less than or equal to the maximum grayscale.

For each grayscale Lm, a corresponding gate-source voltage Vgs_Lm of the driving transistor is preset (the gate-source voltage may be preset manually to output a driving current actually required by each of the different grayscales). An exemplary description is given below by taking the acquisition of duration t_Lm of the step S102 corresponding to the data voltage Vdata_Lm as an example.

The data voltage Vdata_Lm is supplied to the pixel driving circuit, then the pixel driving circuit is controlled to operate by using the pixel driving method provided by the present disclosure, the gate-source voltage of the driving transistor DTFT is monitored in real time when performing the step S102, the step S102 is ended when the gate-source voltage of the driving transistor DTFT is equal to Vgs_Lm, and the duration t_Lm of the step S102 is measured.

The duration of the step S102 corresponding to each data voltage in the new operating voltage range may be measured in the same way, and then a correspondence table, in which different data voltages and the corresponding durations of the step S102 are recorded, is created. In an actual pixel driving process, before the step S102 is performed, the duration of the step S102 corresponding to the currently loaded data voltage of the pixel unit is obtained by looking up the correspondence table in the step S102*a*.

It should be noted that the specific implementation of determining the duration of the step S102 in the step S102*a* is not limited in the embodiment of the present disclosure.

Figure 3A:
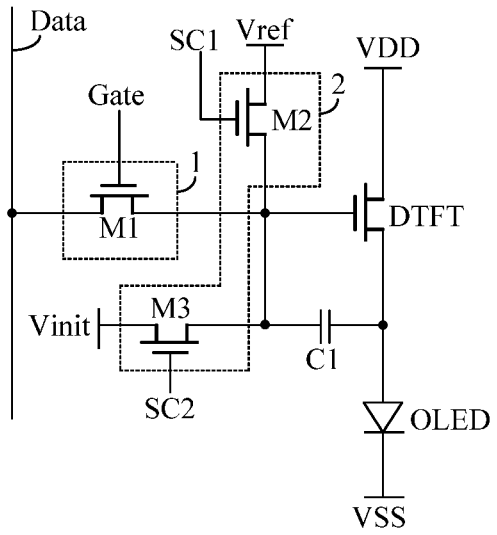
FIG. 3*a* is a schematic diagram of a circuit structure of another pixel driving circuit according to an embodiment of the present disclosure.
Figure 3B:
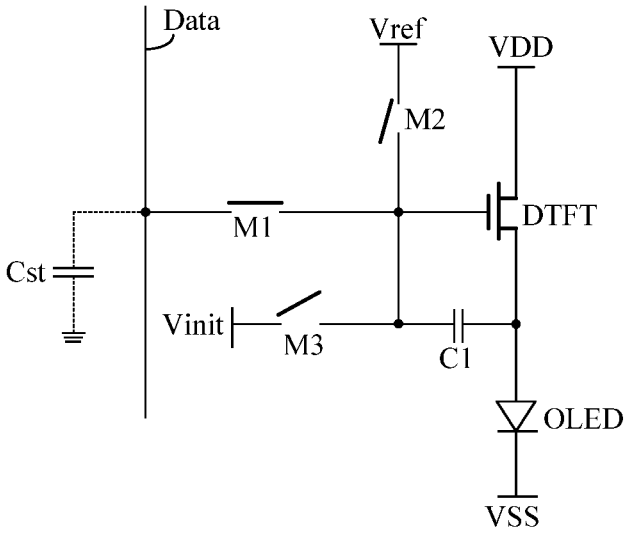
FIG. 3*b* is an equivalent circuit diagram of the pixel driving circuit shown in FIG. 3*a* when the pixel driving circuit operates in a gate-source voltage reducing stage.

FIG. 3*a* is a schematic diagram of a circuit structure of another pixel driving circuit according to an embodiment of the present disclosure, and FIG. 3*b* is an equivalent circuit diagram of the pixel driving circuit shown in FIG. 3*a* when the pixel driving circuit operates in a gate-source voltage reducing stage. As shown in FIG. 3*a* and FIG. 3*b*, the pixel driving circuit further includes a threshold compensation circuit 2 coupled to the control electrode of the driving transistor DTFT and the first electrode of the driving transistor DTFT.

In some embodiments, the data writing circuit 1 includes a first transistor M1. A control electrode of the first transistor M1 is coupled to a gate line Gate, a first electrode of the first transistor M1 is coupled to the data line Data, and a second electrode of the first transistor M1 is coupled to the first terminal of the storage capacitor C1.

In some embodiments, the threshold compensation circuit 2 includes a second transistor M2 and a third transistor M3. A control electrode of the second transistor M2 is coupled to a first control signal line SC1, a first electrode of the second transistor M2 is coupled to a first voltage supply terminal, and a second electrode of the second transistor M2 is coupled to the first terminal of the storage capacitor C1. A control electrode of the third transistor M3 is coupled to a second control signal line SC2, a first electrode of the third transistor M3 is coupled to the second terminal of the storage capacitor C1, and a second electrode of the third transistor M3 is coupled to a second voltage supply terminal.

Figure 4:
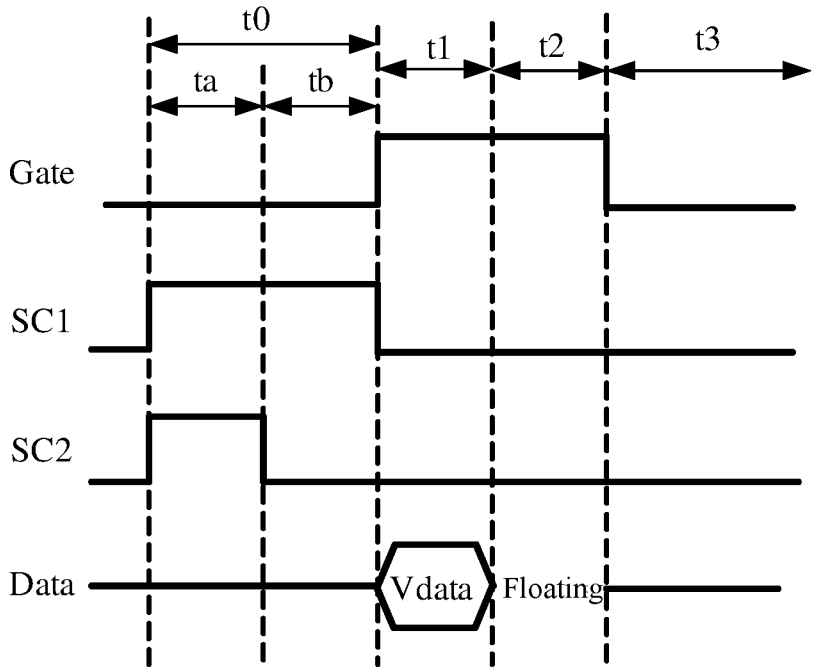
FIG. 4 is an operation timing diagram of the pixel driving circuit shown in FIG. 3*a;*
Figure 5:
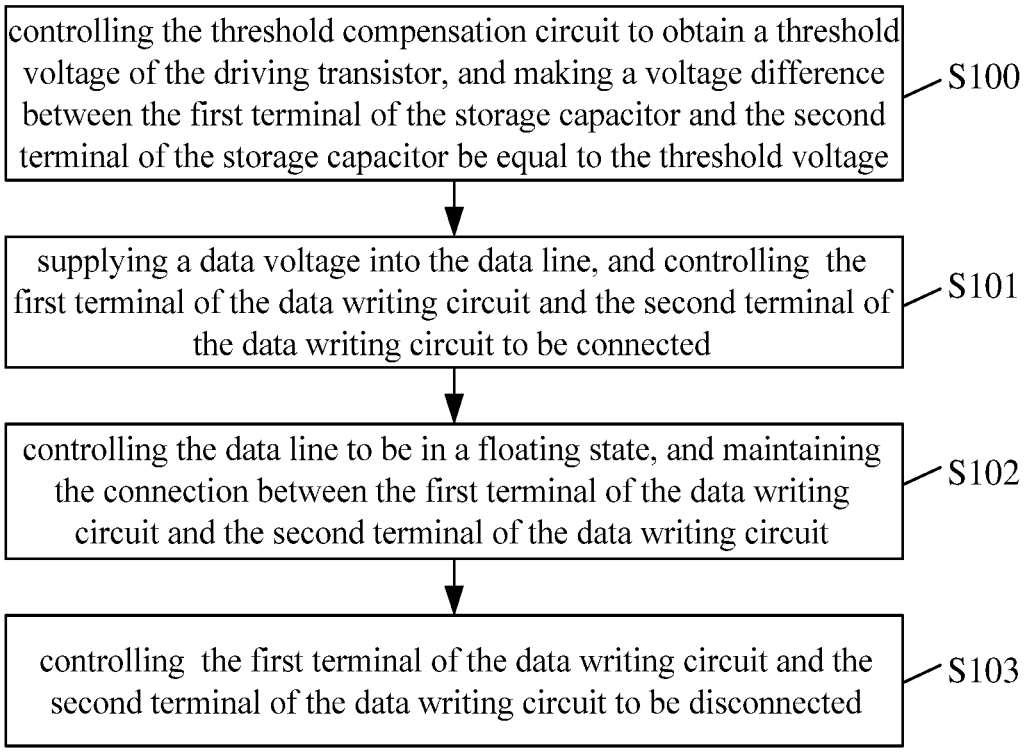
FIG. 5 is a flowchart of another pixel driving method according to an embodiment of the present disclosure.

FIG. 4 is an operation timing diagram of the pixel driving circuit shown in FIG. 3*a*, and FIG. 5 is a flowchart of another pixel driving method according to an embodiment of the present disclosure. The pixel driving method illustrated in FIG. 5 is described in detail below with reference to the operating sequence shown in FIG. 4. As shown in FIG. 4 and FIG. 5, the pixel driving method includes the following steps.

Step S100 includes: controlling the threshold compensation circuit to obtain a threshold voltage of the driving transistor, and making a voltage difference between the first terminal of the storage capacitor and the second terminal of the storage capacitor be equal to the threshold voltage.

The step S100 is a resetting and threshold voltage capturing stage to, which includes a resetting sub-stage ta and a threshold voltage capturing sub-stage tb.

In the resetting sub-stage ta, a scan signal supplied by the gate line Gate is in a low level state, a first control signal supplied by the first control signal line SC1 is in a high level state, and a second control signal supplied by the second control signal line is in a high level state. The first transistor M1 is in an off state, and the second transistor M2 and the third transistor M3 are in an on state. A first voltage Vref supplied by the first voltage supply terminal and a second voltage Vinit supplied by the second voltage supply terminal are written into the first terminal and the second terminal of the storage capacitor C1 through the second transistor M2 and the third transistor M3, respectively, so as to achieve the resetting.

In the threshold voltage capturing sub-stage tb, the scan signal supplied by the gate line Gate is in a low level state, the first control signal supplied by the first control signal line SC1 is in a high level state, and the second control signal supplied by the second control signal line is in a low level state. The first transistor M1 and the third transistor M3 are in an off state, and the second transistor M2 is in an on state. At this time, the driving transistor DTFT is in an on state and outputs a current to charge the second terminal of the storage capacitor C1. When the voltage of the second terminal of the storage capacitor C1 is increased to Vref-Vth, the driving transistor DTFT is turned off and the charging ends, where Vth is the threshold voltage of the driving transistor DTFT. At this time, a voltage difference between the two terminals of the storage capacitor C1 is Vth, that is, the capture of the threshold voltage of the driving transistor DTFT is completed.

Step S101 includes: loading a data voltage into the data line, and controlling the first terminal of the data writing circuit and the second terminal of the data writing circuit to be connected.

The step S101 is a data writing stage t1, in which the scan signal supplied by the gate line Gate is in a high level state, the first control signal supplied by the first control signal line SC1 is in a low level state, and the second control signal supplied by the second control signal line is in a low level state. The first transistor M1 is in an on state, and the second transistor M2 and the third transistor M3 are in an off state.

The data voltage is written into the data line Data from an external circuit, and then is written into the control electrode of the driving transistor DTFT (the first terminal of the storage capacitor C1) through the first transistor M1 to complete the data writing. At this time, the voltage of the first terminal of the storage capacitor C1 is Vdata, the voltage variation of the first terminal of the storage capacitor C1 is Vdata−Vref, and the voltage of the second terminal of the storage capacitor C1 is Vref−Vth+ΔV0 under the bootstrap effect of the storage capacitor C1. Since the storage capacitor C1 is coupled in series with an equivalent capacitor Coled of the light-emitting element, it can be obtained according to charge conservation that:

$$\Delta V0=(V\text{data}-V\text{ref})*C1/(C1+\text{Coled})$$

At the end of the step S101, the gate-source voltage Vgs of the driving transistor DTFT satisfies:

$$Vgs=(V\text{data}-V\text{ref})*\text{Coled}/(C1+\text{Coled})+Vth$$

Step S102 includes: controlling the data line to be in a floating state, and maintaining the connection between the first terminal of the data writing circuit and the second terminal of the data writing circuit.

With reference to FIG. 3*b*, the step S102 is a gate-source voltage reducing stage t2, in which the scan signal supplied by the gate line Gate is in a high level state, the first control signal supplied by the first control signal line SC1 is in a low level state, and the second control signal supplied by the second control signal line is in a low level state.

The data line Data and other lines (e.g., a gate line, an adjacent data line, a signal sensing line, etc.) on a display substrate generate the parasitic capacitance Cst through mutual capacitance.

Reference may be made to the corresponding content in the foregoing embodiments for the detailed description of the step S102, which is not repeated here. At the end of the step S102, Vgs'=Vgs−ΔV*Cst/(C1+Cst), where ΔV is the voltage variation of the second terminal of the storage capacitor C1 during the step S102, and ΔV>0; the magnitude of ΔV is related to factors such as a current output by the driving transistor DTFT, the duration of the step S102, the capacitance of the storage capacitor C1, and the equivalent capacitance of the light-emitting element; and the larger the current is or the longer the duration of the step S102 is, the larger ΔV is, and the smaller the capacitance of the storage capacitor C1 is or the smaller the equivalent capacitance of the light-emitting element is, the larger ΔV is.

In practical applications, the magnitude of ΔV may be controlled by controlling the duration of the step S102, so as to control a reduction ΔV*Cst/(C1+Cst) of the gate-source voltage of the driving transistor DTFT in the step S102.

Step S103 includes: controlling the first terminal of the data writing circuit and the second terminal of the data writing circuit to be disconnected.

The step S103 is a stable light-emitting stage t3, in which the first terminal of the data writing circuit 1 and the second terminal of the data writing circuit 1 are disconnected, and at this time, the driving transistor DTFT outputs the driving current under the action of the gate-source voltage Vgs' to drive the light-emitting element to emit light.

It can be obtained according to a saturated driving current formula of the driving transistor DTFT that:

$$\begin{aligned} I &= K*(Vgs'-Vth)^2 \\ &= K*[Vgs+\Delta V*Cst/(C1+Cst)-Vth]^2 \\ &= K*[(Vdata-Vref)*Coled/(C1+Coled)+ \\ &\quad Vth+\Delta V*Cst/(C1+Cst)-Vth]^2 \\ &= K*[(Vdata-Vref)*Coled/(C1+Coled)+ \\ &\quad \Delta V*Cst/(C1+Cst)]^2 \end{aligned}$$

where I is the driving current output by the driving transistor DTFT, and K is a constant and is related to a channel width-to-length ratio and electron mobility of the driving transistor DTFT. It can be seen from the above formula that the driving current output by the driving transistor DTFT in the stable light-emitting stage is not related to the threshold voltage of the driving transistor DTFT, so that the threshold compensation of the driving transistor DTFT can be achieved.

By adopting the pixel driving method provided by the embodiment of the present disclosure, not only the threshold compensation of the driving transistor DTFT can be realized, but also the maximum operating voltage corresponding to the pixel unit can be increased, that is, the operating voltage range of the pixel unit can be expanded, which is beneficial to reducing the grayscale loss of the pixel unit.

Figure 6:
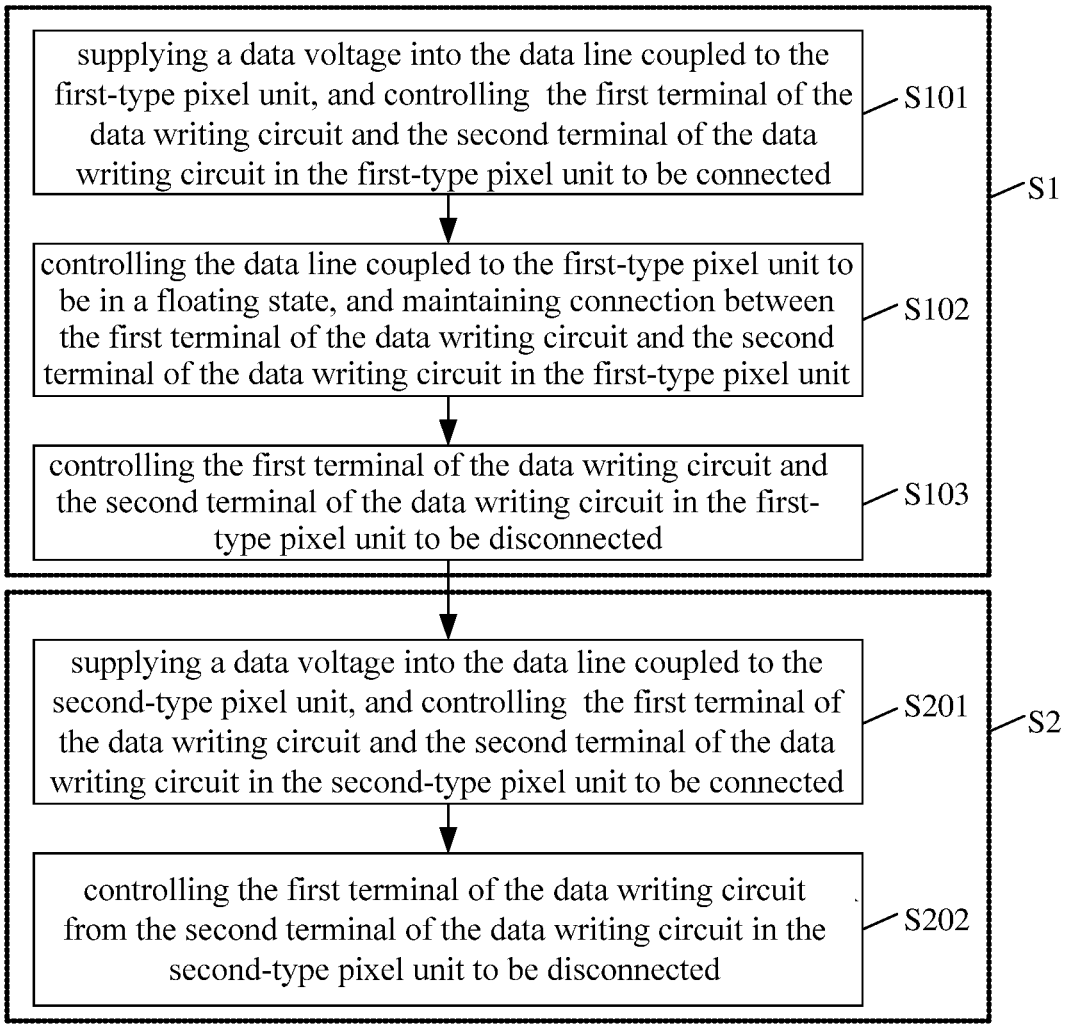
FIG. 6 is a flowchart of a display driving method according to an embodiment of the present disclosure.

FIG. 6 is a flowchart of a display driving method according to an embodiment of the present disclosure. As shown in FIG. 6, the display driving method is used for driving a display substrate, which includes a plurality of pixel units arranged in an array. Each of the pixel units includes a pixel driving circuit and a light-emitting element, and the pixel driving circuit includes a driving transistor, a storage capacitor and a data writing circuit. A control electrode of the driving transistor is coupled to a first terminal of the data writing circuit and a first terminal of the storage capacitor, a first electrode of the driving transistor is coupled to a second terminal of the storage capacitor, and a second terminal of the data writing circuit is coupled to a corresponding data line. The plurality of pixel units include a first-type pixel unit and a second-type pixel unit, and the luminous efficiency of the light-emitting element in the first-type pixel unit is greater than that of the light-emitting element in the second-type pixel unit. The display driving method includes the following steps.

Step S1 includes: driving the first-type pixel unit.

The step S1 may include steps as below:

step S101 includes: loading a data voltage into the data line coupled to the first-type pixel unit, and controlling the first terminal of the data writing circuit and the second terminal of the data writing circuit in the first-type pixel unit to be connected.

Step S102 includes: controlling the data line coupled to the first-type pixel unit to be in a floating state, and maintaining the connection between the first terminal of the data writing circuit and the second terminal of the data writing circuit in the first-type pixel unit.

Step S103 includes: controlling the first terminal of the data writing circuit and the second terminal of the data writing circuit in the first-type pixel unit to be disconnected.

In some embodiments, the pixel driving circuit further includes a threshold compensation circuit coupled to the control electrode and the first electrode of the driving transistor. Before the step S101, the step S1 further includes step S100.

In the step S100, the threshold compensation circuit in the first-type pixel unit is controlled to obtain a threshold voltage of the driving transistor, and a voltage difference between the first terminal of the storage capacitor and the second terminal of the storage capacitor is made be equal to the threshold voltage.

Reference may be made to the corresponding content in the foregoing embodiments for the detailed description of the steps S100 to S103, which is not repeated here.

Step S2 includes; driving the second-type pixel unit.

The step S2 may include steps as below.

Step S201 includes: loading a data voltage into the data line coupled to the second-type pixel unit, and controlling the first terminal of the data writing circuit and the second terminal of the data writing circuit in the second-type pixel unit to be connected.

The execution of the step S201 is the same as that of the step S101. Reference may be made to the corresponding content in the foregoing embodiments for the details of the execution of the step S201.

Step S202 includes: controlling the first terminal of the data writing circuit and the second terminal of the data writing circuit in the second-type pixel unit to be disconnected.

The execution of the step S202 is the same as that of the step S103. Reference may be made to the corresponding content in the foregoing embodiments for the details of the execution of the step S202.

In some embodiments, the pixel driving circuit further includes a threshold compensation circuit coupled to the control electrode and the first electrode of the driving transistor. Before the step S201, the step S2 further includes step S200.

In the step S200, the threshold compensation circuit in the second-type pixel unit is controlled to obtain a threshold voltage of the driving transistor, and a voltage difference between the first terminal of the storage capacitor and the second terminal of the storage capacitor is made be equal to the threshold voltage.

The execution of the step S200 is the same as that of the step S100, and reference may be made to the corresponding content in the foregoing embodiments for the details of the execution of the step S200.

The step S2 does not include a process of reducing the gate-source voltage of the driving transistor.

It should be noted that in the technical solutions of the present disclosure, an order of executing the step S1 and the step S2 is not limited. In an actual display driving process, the steps S1 and S2 are executed for a plurality of times.

In the embodiment of the present disclosure, for a pixel unit which has a light-emitting element with relatively high luminous efficiency, the gate-source voltage of the driving transistor can be reduced through the step S102, so that the current output by the driving transistor in the stable light-emitting stage is decreased, and the brightness of the light-emitting element is decreased. Under a condition that the preset maximum luminance of the light-emitting element remains unchanged, the maximum operating voltage corresponding to the pixel unit which has the light-emitting element with relatively high luminous efficiency can be effectively increased (the operating voltage range can be expanded, and the number of grayscales that can be displayed is increased). Under a condition that the maximum operating voltage corresponding to a pixel unit which has a light-emitting element with relatively low luminous efficiency remains unchanged, a difference between the maximum operating voltage corresponding to the pixel unit which has the light-emitting element with relatively high luminous efficiency and the maximum operating voltage corresponding to the pixel unit which has the light-emitting element with relatively low luminous efficiency can be decreased, and in this case the grayscale loss of the pixel unit which has the light-emitting element with relatively high luminous efficiency is effectively reduced.

In some embodiments, the plurality of pixel units include a first pixel unit, a second pixel unit and a third pixel unit; and the luminous efficiency of the light-emitting element in the first pixel unit is greater than that of the light-emitting element in the second pixel unit, and the luminous efficiency of the light-emitting element in the second pixel unit is greater than that of the light-emitting element in the third pixel unit. The first-type pixel unit includes the first pixel unit and the second pixel unit, and the second-type pixel unit includes the third pixel unit.

In some embodiments, the light-emitting element in the first pixel unit is a red light-emitting element, the light-emitting element in the second pixel unit is a green light-emitting element, and the light-emitting element in the third pixel unit is a blue light-emitting element. The luminous efficiency of the red light-emitting element is greater than that of the green light-emitting element, and the luminous efficiency of the green light-emitting element is greater than that of the blue light-emitting element. For ease of description, the pixel unit including the red light-emitting element is referred to as a red pixel unit, the pixel unit including the green light-emitting element is referred to as a green pixel unit, and the pixel unit including the blue light-emitting element is referred to as a blue pixel unit.

In some embodiments, the red pixel unit and the green pixel unit are driven using the pixel driving method of the step S1, and the blue pixel unit is driven using the pixel driving method of the step S2. In this way, the maximum operating voltages Vr_max and Vg_max and the operating voltage ranges of the red pixel unit and the green pixel unit can be both increased, while the maximum operating voltage Vb_max of the blue pixel unit remains unchanged, the difference between Vr_max/Vg_max and Vb_max is decreased, and the number of grayscales lost by the red pixel unit and the green pixel unit is reduced.

Figure 7:
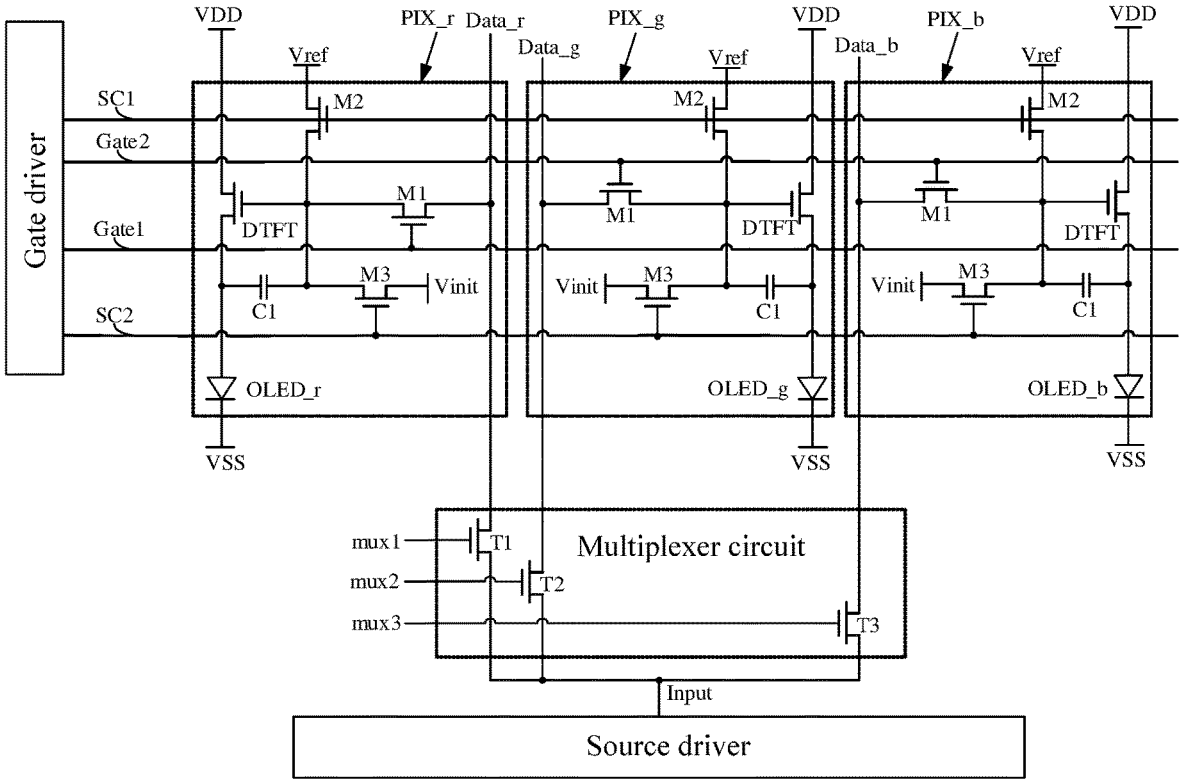
FIG. 7 is a schematic diagram of a circuit structure of a display substrate according to an embodiment of the present disclosure.

FIG. 7 is a schematic diagram of a circuit structure of a display substrate according to an embodiment of the present disclosure. As shown in FIG. 7, the display substrate includes a display region and a non-display region located at the periphery of the display region, the display region includes a plurality of pixel units arranged in an array, each of the pixel units includes a pixel driving circuit and a light-emitting element, and the pixel driving circuit includes a driving transistor DTFT, a storage capacitor C1 and a data writing circuit 1. A control electrode of the driving transistor DTFT is coupled to a first terminal of the data writing circuit 1 and a first terminal of the storage capacitor C1, a first electrode of the driving transistor DTFT is coupled to a second terminal of the storage capacitor C1, a second terminal of the data writing circuit 1 is coupled to a corresponding data line, and a third terminal of the data writing circuit 1 is coupled to a corresponding gate line. The plurality of pixel units include a first-type pixel unit and a second-type pixel unit, and the luminous efficiency of the light-emitting element in the first-type pixel unit is greater than that of the light-emitting element in the second-type pixel unit. The non-display region is provided with a display driver module configured to perform the display driving method provided by the foregoing embodiments.

The display driver module may include a source driver and a gate driver, the source driver is configured to generate a data voltage and output the data voltage to a data line, and the gate driver is configured to generate a scan signal and output the scan signal to a gate line.

In some embodiments, the display region is further provided with a plurality of multiplexer circuits, and each multiplexer circuit corresponds to at least two columns of pixel units. The multiplexer circuit is provided with one data signal input terminal and at least two data signal output terminals, the at least two data signal output terminals are respectively coupled to at least two data lines which are provided for the at least two columns of pixel units corresponding to the multiplexer circuit, and the at least two data signal output terminals are in one-to-one correspondence with the at least two data lines. In this case, the display driver module may further include a control chip configured to control the operation of the multiplexer circuits.

It should be noted that FIG. 7 only exemplarily shows one multiplexer circuit, and the one multiplexer circuit is provided with three data signal output terminals which are coupled to three different data lines, respectively.

In some embodiments, in a case where the pixel driving circuit in the pixel unit includes a threshold compensation circuit 2, the gate driver not only includes a GOA circuit configured to supply scan signals to respective gate lines, but also includes two GOA circuits which are configured to supply control signals to a first control signal line SC1 and a second control signal line SC2, respectively.

In some embodiments, the plurality of pixel units includes a first pixel unit, a second pixel unit and a third pixel unit, the luminous efficiency of the light-emitting element in the first pixel unit is greater than that of the light-emitting element in the second pixel unit, and the luminous efficiency of the light-emitting element in the second pixel unit is greater than that of the light-emitting element in the third pixel unit. The first-type pixel unit includes the first pixel unit and the second pixel unit, and the second-type pixel unit includes the third pixel unit. Each row of pixel units is provided with two gate lines, and for any row of pixel units, all the first pixel units in the row are coupled to one of the two gate lines provided for the row, and all the second and third pixel units in the row are coupled to the other of the two gate lines provided for the row.

In some embodiments, the first pixel unit is a red pixel unit PIX_r, the second pixel unit is a green pixel unit PIX_g, and the third pixel unit is a blue pixel unit PIX_b. The light-emitting element in the red pixel unit PIX_r is a red light-emitting element OLED_r, the light-emitting element in the green pixel unit PIX_g is a green light-emitting element OLED_g, and the light-emitting element in the blue pixel unit PIX_b is a blue light-emitting element OLED_b.

It should be noted that FIG. 7 only exemplarily shows one red pixel unit PIX_r, one green pixel unit PIX_g, and one blue pixel unit PIX_b in a same row.

Figure 8:
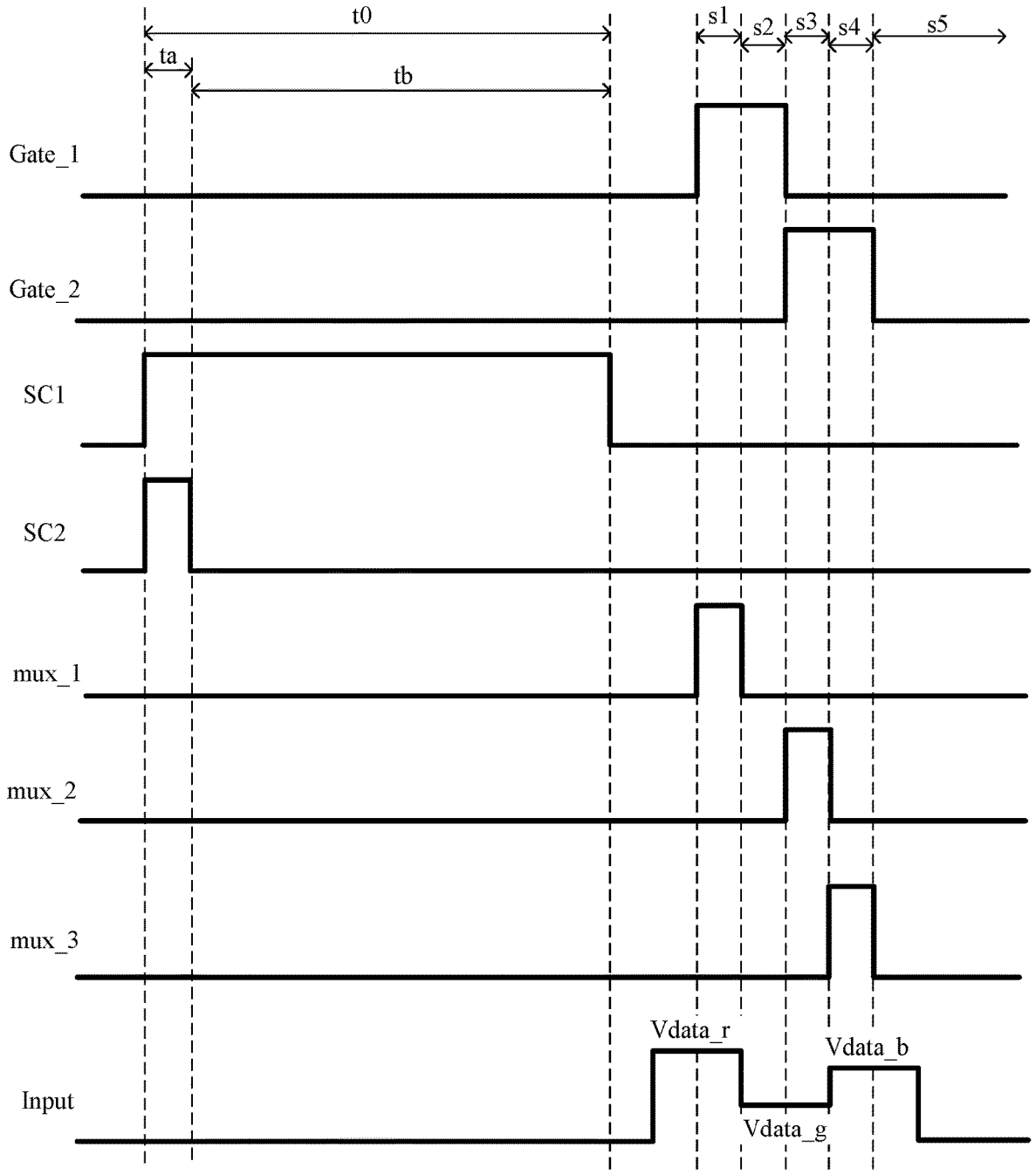
FIG. 8 is a driving timing diagram of the display substrate shown in FIG. 7.

FIG. 8 is a driving timing diagram of the display substrate shown in FIG. 7. As shown in FIG. 8, the pixel driving circuits in the red pixel unit PIX_r, the green pixel unit PIX_g, and the blue pixel unit PIX_b adopt the circuit structure shown in FIG. 3, and the pixel units in the same row are coupled to the same first control signal line SC1 and the same second control signal line SC2. In addition, for ease of description, the gate line coupled to the red pixel unit PIX_r is referred to as a first gate line Gate_1, the gate line coupled to the green pixel unit PIX_g and the blue pixel unit PIX_b is referred to as a second gate line Gate_2, the data line coupled to the red pixel unit PIX_r is referred to as a first data line Data_r, the data line coupled to the green pixel unit PIX_g is referred to as a second data line Data_g, and the data line coupled to the blue pixel unit PIX_b is referred to as a third data line Data_b.

The multiplexer circuit includes a first gating transistor T1, a second gating transistor T2, and a third gating transistor T3. A control electrode of the first gating transistor T1 is coupled to a first gating control signal line mux_1, a first electrode of the first gating transistor T1 is coupled to the data signal input terminal, and a second electrode of the first gating transistor T1 is coupled to the first data line Data_r through one data signal output terminal. A control electrode of the second gating transistor T2 is coupled to a second gating control signal line mux_2, a first electrode of the second gating transistor T2 is coupled to the data signal input terminal, and a second electrode of the second gating transistor T2 is coupled to the second data line Data_g through one data signal output terminal. A control electrode of the third gating transistor T3 is coupled to a third gating control signal line mux_3, a first electrode of the third gating transistor T3 is coupled to the data signal input terminal, and a second electrode of the third gating transistor T3 is coupled to the third data line Data_b through one data signal output terminal.

A process of driving the three pixel units is as follows.

A resetting and threshold voltage capturing stage t0 includes a resetting sub-stage ta and a threshold voltage capturing sub-stage tb.

In the resetting sub-stage ta, a first scan signal supplied by the first gate line Gate_1 is in a low level state, a second scan signal supplied by the second gate line Gate_2 is in a low level state, a first control signal supplied by the first control signal line SC1 is in a high level state, and a second control signal supplied by the second control signal line is in a high level state.

In the red pixel unit PIX_r, the green pixel unit PIX_g and the blue pixel unit PIX_b, the first transistor M1 is in an off state, and the second transistor M2 and the third transistor M3 are in an on state; and a first voltage Vref supplied by a first voltage supply terminal and a second voltage Vinit supplied by a second voltage supply terminal are written into the first terminal and the second terminal of the storage capacitor C1 through the second transistor M2 and the third transistor M3, respectively, so as to achieve the resetting.

In the threshold voltage capturing sub-stage tb, the first scan signal supplied by the first gate line Gate_1 is in a low level state, the second scan signal supplied by the second gate line Gate_2 is in a low level state, the first control signal supplied by the first control signal line SC1 is in a high level state, and the second control signal supplied by the second control signal line is in a low level state.

In the red pixel unit PIX_r, the green pixel unit PIX_g and the blue pixel unit PIX_b, the first transistor M1 and the third transistor M3 are in an off state, and the second transistor M2 is in an on state. At this time, the driving transistor DTFT is in an on state and outputs a current to charge the second terminal of the storage capacitor C1. When the voltage of the second terminal of the storage capacitor C1 is increased to Vref-Vth, the driving transistor DTFT is turned off and the charging ends, where Vth is the threshold voltage of the driving transistor DTFT; at this time, a voltage difference between the two terminals of the storage capacitor C1 is Vth, that is, each pixel unit completes the capture of the threshold voltage of the included driving transistor DTFT.

In a red-light data writing stage s1, the first scan signal supplied by the first gate line Gate_1 is in a high level state, the second scan signal supplied by the second gate line Gate_2 is in a low level state, the first control signal supplied by the first control signal line SC1 is in a low level state, the second control signal supplied by the second control signal line is in a low level state, the source driver supplies a data voltage Vdata_r required by the red pixel unit PIX_r to the multiplexer circuit, a first gating signal supplied by the first gating control signal line mux_1 is in a high level state, a second gating signal supplied by the second gating control signal line mux_2 is in a low level state, and a third gating signal supplied by the third gating control signal line mux_3 is in a low level state.

At this time, the first gating transistor T1 is turned on, the second gating transistor T2 and the third gating transistor T3 are both turned off, and the source driver writes the data voltage Vdata_r into the first data line Data_r through the first gating transistor T1. The first transistor M1 in the red pixel unit PIX_r is turned on, and the data voltage Vdata_r is written to the control electrode of the driving transistor DTFT through the first transistor M1 in the red pixel unit PIX_r.

In a red-light gate-source voltage reducing stage s2, the first scan signal supplied by the first gate line Gate_1 is in a high level state, the second scan signal supplied by the second gate line Gate_2 is in a low level state, the first control signal supplied by the first control signal line SC1 is in a low level state, the second control signal supplied by the second control signal line is in a low level state, the source driver supplies a data voltage Vdata_g required by the green pixel unit PIX_g to the multiplexer circuit, the first gating signal supplied by the first gating control signal line mux_1 is in a low level state, the second gating signal supplied by the second gating control signal line mux_2 is in a low level state, and the third gating signal supplied by the third gating control signal line mux_3 is in a low level state.

At this time, the first gating transistor T1, the second gating transistor T2, and the third gating transistor T3 are all turned off. The first data line Data_r is in a floating state, and in the red pixel unit PIX_r, the gate-source voltage of the driving transistor DTFT is reduced.

In a green-light data writing and red-light emitting stage s3, the first scan signal supplied by the first gate line Gate_1 is in a low level state, the second scan signal supplied by the second gate line Gate_2 is in a high level state, the first control signal supplied by the first control signal line SC1 is in a low level state, the second control signal supplied by the second control signal line is in a low level state, the source driver supplies the data voltage Vdata_g required by the green pixel unit PIX_g to the multiplexer circuit, the first gating signal supplied by the first gating control signal line mux_1 is in a low level state, the second gating signal supplied by the second gating control signal line mux_2 is in a high level state, and the third gating signal supplied by the third gating control signal line mux_3 is in a low level state.

At this time, the second gating transistor T2 is turned on, and the first gating transistor T1 and the third gating transistor T3 are both turned off; and the first transistor M1 in the red pixel unit PIX_r is turned off, and the driving transistor DTFT in the red pixel unit PIX_r outputs a stable driving current, and the red light-emitting element OLED_r emits light stably. The source driver writes the data voltage Vdata_g into the second data line Data_g through the second gating transistor T2, the first transistor M1 in the green pixel unit PIX_g is turned on, and the data voltage Vdata_g is written to the control electrode of the driving transistor DTFT through the first transistor M1 in the green pixel unit PIX_g.

In a green-light gate-source voltage reducing and blue-light data writing stage s4, the first scan signal supplied by the first gate line Gate_1 is in a low level state, the second scan signal supplied by the second gate line Gate_2 is in a high level state, the first control signal supplied by the first control signal line SC1 is in a low level state, the second control signal supplied by the second control signal line is in a low level state, the source driver supplies a data voltage Vdata_b required by the blue pixel unit PIX_b to the multiplexer circuit, the first gating signal supplied by the first gating control signal line mux_1 is in a low level state, the second gating signal supplied by the second gating control signal line mux_2 is in a low level state, and the third gating signal supplied by the third gating control signal line mux_3 is in a high level state.

At this time, the third gating transistor T3 is turned on, the first gating transistor T1 and the second gating transistor T2 are both turned off, the second data line Data_g is in a floating state, and in the green pixel unit PIX_g, the gate-source voltage of the driving transistor DTFT is reduced. Meanwhile, the source driver writes a data voltage Vdata_b into the third data line Data_b through the third gating transistor T3, the first transistor M1 in the blue pixel unit PIX_b is turned on, and the Data voltage Vdata_b is written to the control electrode of the driving transistor DTFT through the first transistor M1 in the blue pixel unit PIX_b.

In a green-light emitting and blue-light emitting stage s5, the first scan signal supplied by the first gate line Gate_1 is in a low level state, the second scan signal supplied by the second gate line Gate_2 is in a low level state, the first control signal supplied by the first control signal line SC1 is in a low level state, the second control signal supplied by the second control signal line is in a low level state, the source driver supplies the data voltage Vdata_b required by the blue pixel unit PIX_b to the multiplexer circuit, the first gating signal supplied by the first gating control signal line mux_1 is in a low level state, the second gating signal supplied by the second gating control signal line mux_2 is in a low level state, and the third gating signal supplied by the third gating control signal line mux_3 is in a low level state.

At this time, the first gating transistor T1, the second gating transistor T2, and the third gating transistor T3 are all turned off; the first transistors M1 in the green pixel unit PIX_g and the blue pixel unit PIX_b are both turned off, and the driving transistors DTFT in the green pixel unit PIX_g and the blue pixel unit PIX_b both output a stable driving current, and both the green light-emitting element OLED_g and the blue light-emitting element OLED_b emit light stably.

In the above embodiment, for each of the red pixel unit PIX_r and the green pixel unit PIX_g, the duration of the data voltage writing process is equal to the duration of the gate-source voltage reducing process.

It should be noted that, in the embodiment of the present disclosure, the red pixel unit PIX_r and the green pixel unit PIX_g are respectively driven by different gate lines, so as to facilitate adjusting, according to different application scenarios, the duration of the gate-source voltage reducing stage corresponding to the red pixel unit PIX_r and the duration of the gate-source voltage reducing stage corresponding to the green pixel unit PIX_g, respectively.

As an example, by increasing a pulse-width of a driving signal loaded into the gate line coupled to the red pixel unit PIX_r, the duration of the gate-source voltage reducing stage corresponding to the red pixel unit PIX_r is extended, that is, the duration of the gate-source voltage reducing stage corresponding to the red pixel unit PIX_r is longer than the duration of the gate-source voltage reducing stage corresponding to the green pixel unit PIX_g.

The case in which the pixel driving circuit in the display substrate shown in FIG. 7 is the pixel driving circuit shown in FIG. 3 is only for the purpose of exemplary illustration, and does not limit the technical solutions of the present disclosure; therefore, in the embodiments of the present disclosure, the pixel driving circuit may adopt other circuit structures. In addition, the operating sequence shown in FIG. 8 is only an alternative implementation of the display driving method shown in FIG. 6, and the technical solutions of the present disclosure are not limited thereto.

Figure 9:
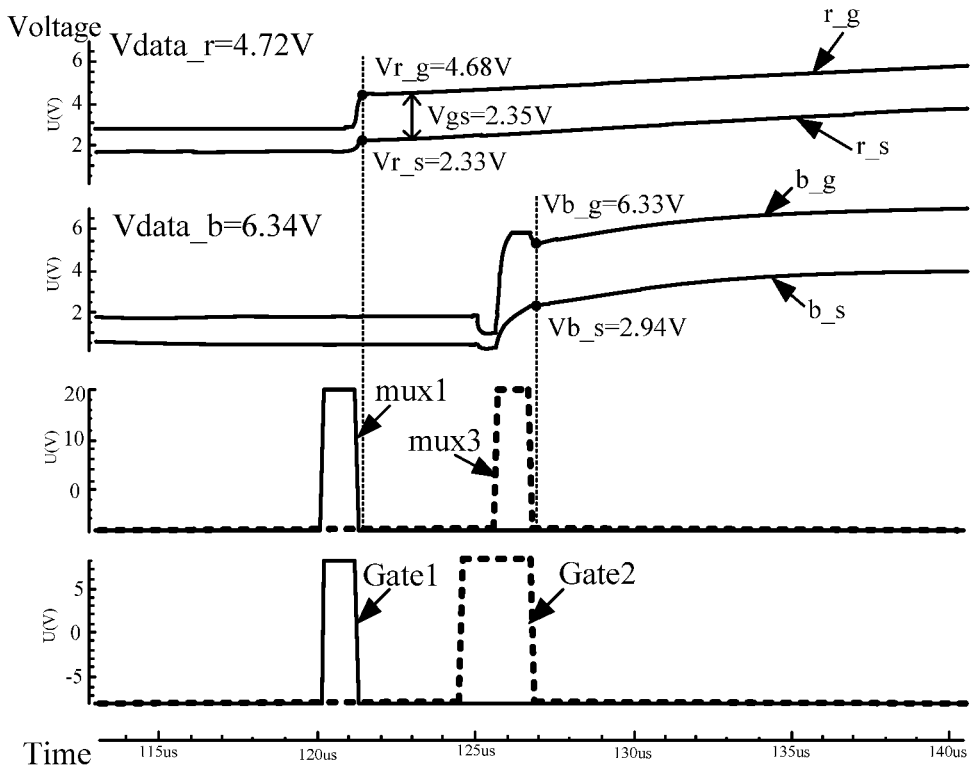
FIG. 9 is a waveform simulation diagram of a gate-source voltage of a driving transistor when a red pixel unit and a blue pixel unit in the display substrate shown in FIG. 7 are driven using an existing pixel driving method.
Figure 10:
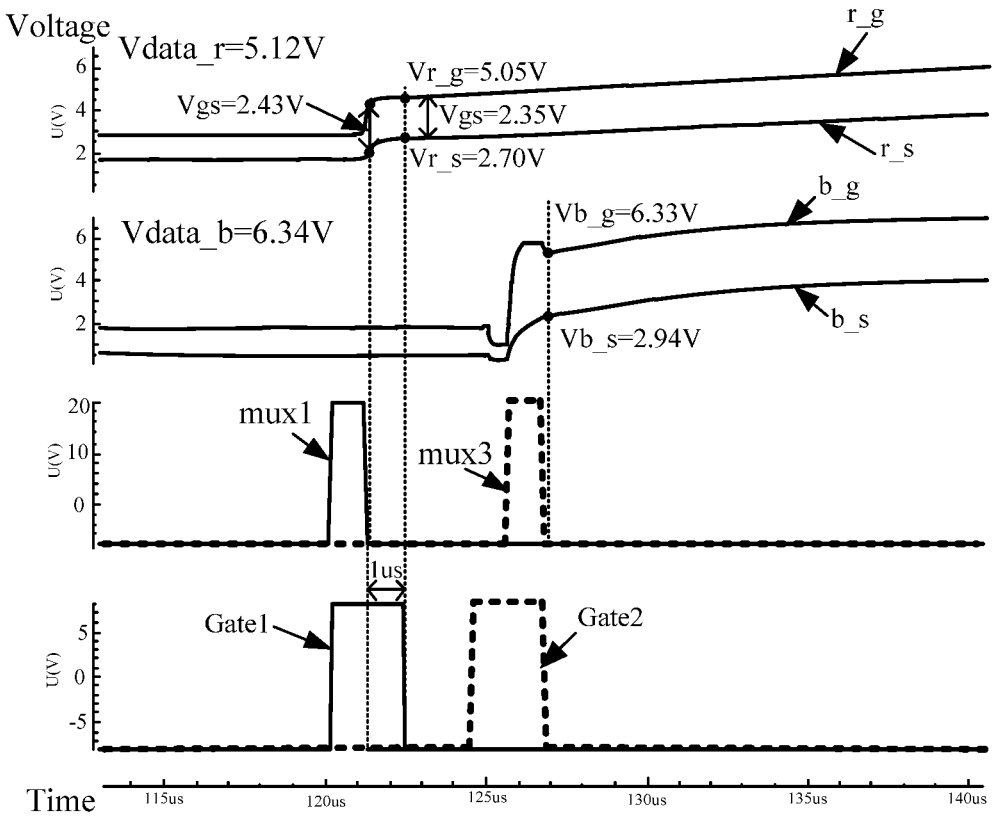
FIG. 10 is a waveform simulation diagram of a gate-source voltage of a driving transistor when a red pixel unit in the display substrate shown in FIG. 7 is driven using a pixel driving method provided by the present disclosure.

FIG. 9 is a waveform simulation diagram of a gate-source voltage of a driving transistor when a red pixel unit and a blue pixel unit in the display substrate shown in FIG. 7 are driven with an existing pixel driving method; and FIG. 10 is a waveform simulation diagram of a gate-source voltage of a driving transistor when a red pixel unit in the display substrate shown in FIG. 7 is driven with a pixel driving method provided by the present disclosure. With reference to FIG. 7 and FIG. 8, a case where the threshold voltage of the driving transistor is 2V, and the red pixel unit PIX_r and the blue pixel unit PIX_b are controlled to reach the preset maximum luminance 150 nit is taken as an example.

With reference to FIG. 9, in the case of driving with the existing pixel driving method, the measured data voltage required to be supplied to the red pixel unit PIX_r is Vdata_r=4.72V, and after the data writing is completed, a voltage at a node r_g is Vr_g=4.68V, a voltage at a node r_s is Vr_s=2.33V, and the gate-source voltage of the driving transistor at this time is Vgs=2.35V. The data voltage required to be supplied to the blue pixel unit PIX_b is Vdata_b=6.34V, and after the data writing is completed, a voltage at a node b_g is Vb_g=6.33V, and a voltage of a node b_s is Vb_s=2.94V. It can be seen that in this case, the maximum operating voltage of the red pixel unit PIX_r is 4.72V, the maximum operating voltage of the blue pixel unit PIX_b is 6.34V, and the difference between the maximum operating voltage of the blue pixel unit PIX_b and the maximum operating voltage of the red pixel unit PIX_r is 6.34V−4.72V=1.62V.

With reference to FIG. 10, in the case where the red pixel unit PIX_r is driven with the pixel driving method provided by the present disclosure, the measured data voltage required to be supplied to the red pixel unit PIX_r is Vdata_r=5.12V, and the gate-source voltage of the driving transistor is Vgs=2.43V after the data writing is completed; and after the gate-source voltage reducing stage (the duration of the gate-source voltage reducing stage is set to 1 μs), the voltage at the node r_g is Vr_g=5.05V, the voltage at the node r_s is Vr_s=2.70V, and the gate-source voltage Vgs of the driving transistor is reduced to 2.35V (it is ensured that the luminance of the red light-emitting element OLED_r is 150 nit). In the case of driving the blue pixel unit PIX_b with the existing pixel driving method, the data voltage supplied to the blue pixel unit PIX_b is Vdata_b=6.34V, and after the data writing is completed, the voltage at the node b_g is Vb_g=6.33V, and the voltage at the node b_s is Vb_s=2.94V. It can be seen that the maximum operating voltage of the red pixel unit PIX_r is 5.12V, the maximum operating voltage of the blue pixel unit PIX_b is 6.34V, and the difference between the maximum operating voltage of the blue pixel unit PIX_b and the maximum operating voltage of the red pixel unit PIX_r is 6.34V−5.12V=1.22V.

It can be seen that, by adopting the pixel driving method provided by the present disclosure to drive the red pixel unit PIX_r, the maximum operating voltage of the red pixel unit PIX_r can be increased (the operating voltage range can be increased), the voltage difference between the maximum operating voltage of the blue pixel unit PIX_b and the maximum operating voltage of the red pixel unit PIX_r can be decreased, so that the number of the grayscales lost by the red pixel unit can be effectively reduced when the grayscale expansion is performed based on the operating voltage range of the blue pixel unit.

It could be understood that the above embodiments are merely exemplary embodiments employed to illustrate the principles of the present disclosure, and the present disclosure is not limited thereto. Various modifications and improvements can be made by those of ordinary skill in the art without departing from the spirit and essence of the present disclosure, and those modifications and improvements should also be considered to fall within the scope of the present disclosure.

What is claimed is:

1. A pixel driving method for driving a pixel unit, wherein the pixel unit comprises a pixel driving circuit, the pixel driving circuit comprises a driving transistor, a storage capacitor, and a data writing circuit, a control electrode of the driving transistor is coupled to a first terminal of the data writing circuit and a first terminal of the storage capacitor, a first electrode of the driving transistor is coupled to a second terminal of the storage capacitor, and a second terminal of the data writing circuit is coupled to a data line; and the pixel driving method comprises:

supplying a data voltage into the data line, and controlling the first terminal of the data writing circuit and the second terminal of the data writing circuit to be connected;

controlling the data line to be in a floating state, and maintaining connection between the first terminal of the data writing circuit and the second terminal of the data writing circuit, so as to reduce a gate-source voltage of the driving transistor; and controlling the first terminal of the data writing circuit and the second terminal of the data writing circuit to be disconnected.

2. The pixel driving method of claim 1, wherein the pixel driving circuit further comprises a threshold compensation circuit coupled to the control electrode of the driving transistor and the first electrode of the driving transistor; and before supplying the data voltage into the data line, the pixel driving method further comprises:

controlling the threshold compensation circuit to obtain a threshold voltage of the driving transistor, and making a voltage difference between the first terminal of the storage capacitor and the second terminal of the storage capacitor be equal to the threshold voltage.

3. The pixel driving method of claim 1, wherein before controlling the data line to be in the floating state, and maintaining the connection between the first terminal of the data writing circuit and the second terminal of the data writing circuit, the pixel driving method further comprises:

determining a duration of the floating state of the data line according to the data voltage.

4. The pixel driving method of claim 3, wherein the durations of the floating state of the data line corresponding to different data voltages are the same;

or, the durations of the floating state of the data line corresponding to different data voltages are different.

5. The pixel driving method of claim 1, wherein a duration of the step of controlling the data line to be in the floating state, and maintaining the connection between the first terminal of the data writing circuit and the second terminal of the data writing circuit is in the range of 0.5 μs to 1.5 μs.

6. The pixel driving method of claim 1, wherein a duration of the step of supplying the data voltage into the data line, and controlling the first terminal of the data writing circuit and the second terminal of the data writing circuit to be connected is t1; and a duration of the step of controlling the data line to be in the floating state, and maintaining the connection between the first terminal of the data writing circuit and the second terminal of the data writing circuit is t2, and t2=t1.

7. A display driving method for driving a display substrate, wherein the display substrate comprises a plurality of pixel units arranged in an array, each of the plurality of pixel units comprises a pixel driving circuit and a light-emitting element, the pixel driving circuit comprises a driving transistor, a storage capacitor, and a data writing circuit, a control electrode of the driving transistor is coupled to a first terminal of the data writing circuit and a first terminal of the storage capacitor, a first electrode of the driving transistor is coupled to a second terminal of the storage capacitor, and a second terminal of the data writing circuit is coupled to a corresponding data line;

the plurality of pixel units comprises a first-type pixel unit and a second-type pixel unit, and luminous efficiency of the light-emitting element in the first-type pixel unit is greater than luminous efficiency of the light-emitting element in the second-type pixel unit; and the display driving method comprises:

driving the first-type pixel unit, which comprises:

supplying a data voltage into the data line coupled to the first-type pixel unit, and controlling the first terminal of the data writing circuit and the second terminal of the data writing circuit in the first-type pixel unit to be connected;

controlling the data line coupled to the first-type pixel unit to be in a floating state, and maintaining connection between the first terminal of the data writing circuit and the second terminal of the data writing circuit in the first-type pixel unit, so as to reduce a gate-source voltage of the driving transistor; and controlling the first terminal of the data writing circuit and the second terminal of the data writing circuit in the first-type pixel unit to be disconnected.

8. The display driving method of claim 7, wherein in a process of driving the first-type pixel unit, before controlling the data line coupled to the first-type pixel unit to be in the floating state, and maintaining the connection between the first terminal of the data writing circuit and the second terminal of the data writing circuit in the first-type pixel unit, the display driving method further comprises:

determining a duration of the floating state of the data line according to the data voltage.

9. The display driving method of claim 8, wherein the durations of the floating state of the data line corresponding to different data voltages are the same;

or, the durations of the floating state of the data line corresponding to different data voltages are different.

10. The display driving method of claim 7, wherein the pixel driving circuit further comprises a threshold compensation circuit coupled to the control electrode of the driving transistor and the first electrode of the driving transistor;

in the process of driving the first-type pixel unit, before supplying the data voltage into the data line coupled to the first-type pixel unit, and controlling the first terminal of the data writing circuit and the second terminal of the data writing circuit in the first-type pixel unit to be connected, the display driving method further comprises:

controlling the threshold compensation circuit in the first-type pixel unit to obtain a threshold voltage of the driving transistor, and making a voltage difference between the first terminal of the storage capacitor and the second terminal of the storage capacitor be equal to the threshold voltage.

11. The display driving method of claim 7, further comprising:

driving the second-type pixel unit, which comprises:

supplying a data voltage into the data line coupled to the second-type pixel unit, and controlling the first terminal of the data writing circuit and the second terminal of the data writing circuit in the second-type pixel unit to be connected; and controlling the first terminal of the data writing circuit and the second terminal of the data writing circuit in the second-type pixel unit to be disconnected.

12. The display driving method of claim 11, wherein the pixel driving circuit further comprises a threshold compensation circuit coupled to the control electrode of the driving transistor and the first electrode of the driving transistor; and in a process of driving the second-type pixel unit, before supplying the data voltage into the data line coupled to the second-type pixel unit, and controlling the first terminal of the data writing circuit and the second terminal of the data writing circuit in the second-type pixel unit to be connected, the display driving method further comprises:

controlling the threshold compensation circuit in the second-type pixel unit to obtain a threshold voltage of the driving transistor, and making a voltage difference between the first terminal of the storage capacitor and the second terminal of the storage capacitor be equal to the threshold voltage.

13. The display driving method of claim 7, wherein the plurality of pixel units comprise a first pixel unit, a second pixel unit, and a third pixel unit, luminous efficiency of the light-emitting element in the first pixel unit is greater than luminous efficiency of the light-emitting element in the second pixel unit, and the luminous efficiency of the light-emitting element in the second pixel unit is greater than luminous efficiency of the light-emitting element in the third pixel unit; and the first-type pixel unit comprises the first pixel unit and the second pixel unit, and the second-type pixel unit comprises the third pixel unit.

14. The display driving method of claim 13, wherein the light-emitting element in the first pixel unit is a red light-emitting element, the light-emitting element in the second pixel unit is a green light-emitting element, and the light-emitting element in the third pixel unit is a blue light-emitting element.

15. A display substrate, comprising a display region and a non-display region on the periphery of the display region, wherein the display region comprises a plurality of pixel units arranged in an array, each of the plurality of pixel units comprises a pixel driving circuit and a light-emitting element, the pixel driving circuit comprises a driving transistor, a storage capacitor and a data writing circuit, a control electrode of the driving transistor is coupled to a first terminal of the data writing circuit and a first terminal of the storage capacitor, a first electrode of the driving transistor is coupled to a second terminal of the storage capacitor, a second terminal of the data writing circuit is coupled to a corresponding data line, and a third terminal of the data writing circuit is coupled to a corresponding gate line;

the plurality of pixel units comprise a first-type pixel unit and a second-type pixel unit, and luminous efficiency of the light-emitting element in the first-type pixel unit is greater than luminous efficiency of the light-emitting element in the second-type pixel unit; and the non-display region is provided with a display driver module configured to perform the display driving method of claim 7.

16. The display substrate of claim 15, wherein the plurality of pixel units comprises a first pixel unit, a second pixel unit, and a third pixel unit, luminous efficiency of the light-emitting element in the first pixel unit is greater than luminous efficiency of the light-emitting element in the second pixel unit, and the luminous efficiency of the light-emitting element in the second pixel unit is greater than luminous efficiency of the light-emitting element in the third pixel unit;

the first-type pixel unit comprises the first pixel unit and the second pixel unit, and the second-type pixel unit comprises the third pixel unit; and each row of pixel units is provided with two gate lines, and for any row of pixel units, all first pixel units in the row are coupled to one of the two gate lines provided for the row, and all second and third pixel units in the row are coupled to the other of the two gate lines provided for the row.

17. The display substrate of claim 15, wherein the non-display region is further provided with a plurality of multiplexer circuits, and each of the plurality of multiplexer circuits corresponds to at least two columns of pixel units;

each of the plurality of multiplexer circuits is provided with one data signal input terminal and at least two data signal output terminals, the at least two data signal output terminals are respectively coupled to at least two data lines provided for the at least two columns of pixel units corresponding to the multiplexer circuit, and the at least two data signal output terminals are in one-to-one correspondence with the at least two data lines.

18. The display substrate of claim 15, wherein the light-emitting element comprises an organic light-emitting diode.

* * * * *